US006698204B2

(12) United States Patent
Berndt et al.

(10) Patent No.: US 6,698,204 B2
(45) Date of Patent: Mar. 2, 2004

(54) STEAM GENERATOR PLANT

(75) Inventors: Thoralf Berndt, Stuttgart (DE); Joachim Seeber, Wernau (DE)

(73) Assignee: Alstom (Switzerland) Ltd., Baden (CH)

( * ) Notice: Subject to any disclaimer, the term of this patent is extended or adjusted under 35 U.S.C. 154(b) by 159 days.

(21) Appl. No.: 09/928,283

(22) Filed: Aug. 10, 2001

(65) Prior Publication Data

US 2002/0017100 A1 Feb. 14, 2002

(30) Foreign Application Priority Data

Aug. 11, 2000 (DE) ..... 100 39 317

(51) Int. Cl.[7] ..... F01K 7/34
(52) U.S. Cl. ..... 60/653; 60/679
(58) Field of Search ..... 60/653, 670, 679

(56) References Cited

U.S. PATENT DOCUMENTS 2,967,397 A * 1/1961 Vogler ..... 60/679
4,430,094 A * 2/1984 Gorzegno ..... 48/76
4,598,551 A * 7/1986 Dimitroff et al. ..... 60/646
5,038,568 A * 8/1991 Gounder et al. ..... 60/679
5,605,118 A * 2/1997 Sinn et al. ..... 122/479.1
6,035,642 A * 3/2000 Peletz et al. ..... 60/649
6,058,858 A * 5/2000 Belin et al. ..... 110/245

* cited by examiner

*Primary Examiner*—Hoang Nguyen
(74) *Attorney, Agent, or Firm*—Alix, Yale & Ristas, LLP

(57) ABSTRACT

Steam generator unit having a fluidized-bed combustion system, which has a fluidized-bed combustion chamber, at least one second gas pass, and at least one separator positioned between the fluidized-bed combustion chamber and second gas pass. The steam generator unit also having at least one superheater and two reheaters connected in series on the steam side. The first reheater is constructed with a regulated bypass mechanism on the steam side, so that a partial flow of the steam fed to the second reheater can be directed past the first reheater, such that the first reheater is positioned in the second gas pass and the second reheater is positioned in the fluidized-bed combustion chamber.

11 Claims, 4 Drawing Sheets

STEAM GENERATOR PLANT

BACKGROUND OF THE INVENTION

This invention relates generally to a steam generator plant. More particularly, the present invention relates to a steam generator plant that is connected to a multistage steam turbine and that has a fluidized-bed combustion system, with this system having a fluidized-bed combustion chamber, at least one second gas pass and at least one separator positioned between the fluidized-bed combustion chamber and the second gas pass, at least one superheater, and two reheaters connected in series on the steam side, with the first reheater being constructed with a regulated bypass mechanism on the steam side, so that a partial flow of the steam that is fed to the second reheater can be directed past the first reheater, and it also relates to a procedure for the operating of such a steam generator unit.

In a power-plant facility that uses a steam generator, the energy content of a fuel is used for the evaporation of a working medium or flow medium within the steam generator. In this connection, the working medium is usually conveyed within an evaporator circuit. The steam made available by the steam generator can in turn be provided, for example, for the driving of a steam turbine and/or for an attached external process. If the steam drives a steam turbine, then via the turbine shaft of the steam turbine usually a generator or a machine for doing mechanical work is operated. In the case of a generator, the current produced by the generator can be provided for purposes of feeding it into an interconnected and/or insular network.

Moreover the steam generator unit can be constructed to have a fluidized-bed combustion system, especially a circulating fluidized-bed combustion system. Such a steam generator unit has become familiar, for example, from the printed document EP 0 455 660 B1. This steam generator unit, which is a component of a power plant with a multistage steam turbine, includes a fluidized-bed combustion system that has a fluidized-bed firing, at least one separator, at least one initial and one second stage or final stage of the reheater, which are connected in series, and a superheater. In this connection, the first and the second stage or final stage of the reheater are positioned in series within a common gas channel or a second gas pass of the steam generator, which is connected on the gas side with the fluidized-bed combustion chamber, and also elements are provided for dividing up the steam which comes from the high-pressure section of the steam turbine and which has been expanded in part, into a selective first and second portion, and for a leading of this same first portion through the first stage of the reheater, and elements for re-uniting the first and second portion and a leading of the same through the second stage of the reheater. By means of the above-mentioned arrangement, the steam temperature at the outlet of the reheater system can be regulated without an injection of colder injection water. This elimination of injection water has a positive effect on the overall efficiency of the power-plant facility.

In this familiar steam generator unit, it has proved to be a drawback that the reheater (ZÜ) temperature characteristic is not optimal and thereby the case can arise where the ZÜ temperature of the steam to be heated is not reached at partial load. Furthermore, the number of heating surfaces in the second gas pass has an effect on the overall height of this gas pass. Due to the fact that two reheater heating surfaces are provided in the gas pass, the overall height of the second gas pass is correspondingly greater and more costly.

SUMMARY OF THE INVENTION

The object of the invention, then, is to create a steam generator unit as well as a procedure for operating a steam-generator unit of this species, in which unit and in which procedure the above-mentioned drawbacks can be avoided.

The above-stated object is attained with respect to the steam generator unit by the characterizing features of Patent claim 1, and with respect to the procedure by the characterizing features of Patent claim 8.

Through this achievement in accordance with the invention a steam generator unit as well as a procedure for operating such a unit is created that has the following advantages:

An improvement of the temperature characteristic of the reheater system or of the reheater stages and with that a lower heating-surface requirement. Since the second reheater is arranged within the fluidized-bed combustion chamber, a number of advantages result from this. For one thing, the flue gas (RG) temperature is higher in the combustion chamber compared to the flue-gas temperature in the second pass, and this results in a higher driving temperature difference for the heat transfer to the steam in the second reheater, and as a consequence of this the heating surface needed is smaller. In this connection, it is especially advantageous that in the fluidized-bed combustion chamber, because of the high solid-particle portion in the flue gas the RG temperature is almost constant over the entire height of the second reheater. For another thing, in the fluidized-bed combustion chamber, in addition to the convection heat acting on the reheater stage a greater fraction of radiant heat is added, and this radiant heat is considerably more independent of the boiler load than the convection heat and moreover at partial loads its release of heat flux to this heating surface is reduced to an only insignificant degree. Through the above-named measures, the ZÜ temperature characteristic is considerably improved.

Through the improved temperature characteristic of the reheater in the combustion chamber, smaller bypass flows past the first reheater are needed. Due to the greater flow through the first reheater, a better cooling is achieved. Furthermore, due to the smaller bypass flows, now also the bypass mechanism can be made smaller and at a lower cost.

Through the reduction (elimination of the second reheater stage) of the heating surfaces (heat-recovery area or convection heating surfaces) in the second gas pass, the overall height of the second gas pass can be kept smaller and it can be made at a lower cost.

It is advantageous for the second reheater of the steam generator unit to be constructed as a platen-type heating surface, since thereby the heat transfer to the steam working medium takes place through both convention and also radiation.

The platen-type heating surface of the second reheater in the fluidized-bed combustion chamber can be constructed in the shape of an L (wing walls). This shape can considerably simplify the installation and the linkages of the respective heating-surface tubes. But it can also be conveyed horizontally through the fluidized-bed combustion chamber.

It is particularly advantageous for the steam generator unit to be constructed with a regulation mechanism including at least one flow-rate regulating valve for the dividing up of the steam flow into a partial flow directed through the first reheater and possibly a partial flow directed through the bypass line, where the regulation takes place as a function of the steam temperatures at the inlet and outlet of the first reheater as well as the steam temperatures at the inlet and outlet of the second reheater. By means of this measure an extremely efficient and precise regulation of the steam temperatures in the individual reheater stages is achieved.

From a control-engineering point of view it is advantageous for the flow-rate regulating valve to be constructed as a 3-way valve and to be positioned at the bifurcation to the supply line to the first reheater and to the bypass line. But it can also be expedient to construct the flow-rate regulating valve as a simple straight-through valve and to position it in the bypass line.

In another advantageous embodiment of the invention, in connection with a procedure for the regulation of reheater temperatures in steam generator units of this species, the regulation of the steam flow directed through the first reheater and of the steam flow optionally directed through the bypass line takes place as a function of the steam temperatures at the inlet and outlet of the first reheater as well as of the steam temperatures at the inlet and outlet of the second reheater.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
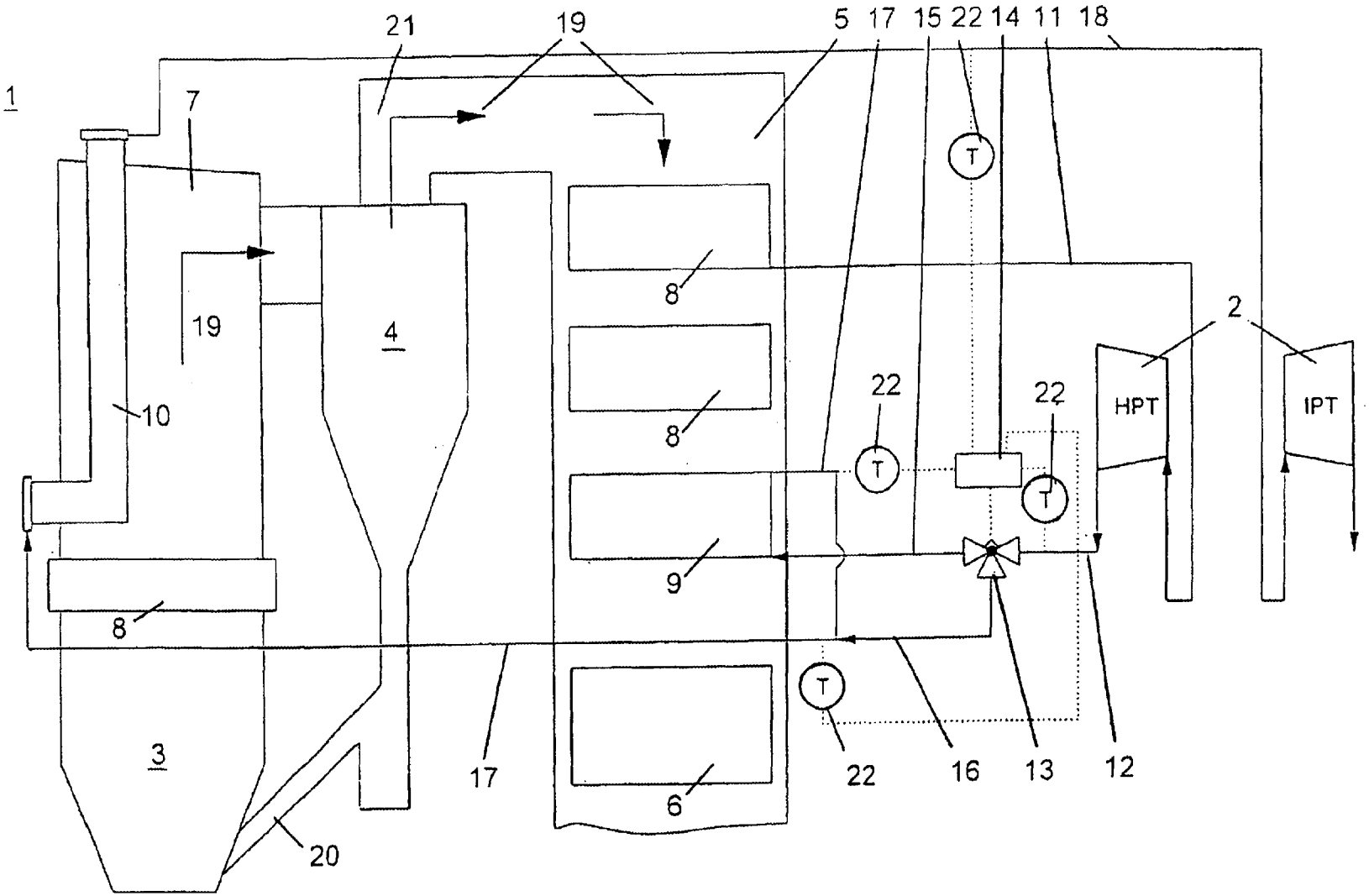
FIG. 1 is a schematic diagram of a first embodiment of a steam generator unit in accordance with the invention.

FIG. 1 shows schematically a steam generator unit 1 for using the heat energy contained in fossil solid or particulate fuels or in other exploitable materials, for example waste products, biomaterials, and the like. The heat released in the combustion of these materials or fuels is for the most part delivered over to a flowing or working medium, which is preferably water/steam or a mixture of these. The steam produced in the steam generator unit 1 is fed to a steam turbine 2, which is usefully at least a two-stage turbine, with the working medium being usually driven within a circuit, namely after the energy release in the steam turbine 2 and a subsequent condensation, the working medium is again fed in sequence to the economizer 6, the evaporator 7, the superheater 8, the high-pressure section of the steam turbine 2, the reheater stages 9, 10, and subsequently to the intermediate-pressure section of the steam turbine 2.

The steam generator unit 1 in accordance with FIG. 1 includes a fluidized-bed combustion system, in particular a circulating fluidized-bed combustion system, which has a fluidized-bed combustion chamber 3, a second gas pass 5 connected to the fluidized-bed combustion chamber 3 on the gas side, and a separator 4 positioned between the fluidized-bed combustion chamber 3 and the second gas pass 5, which in one useful embodiment can be a cyclone separator. The fuel to be burned is combusted in a familiar way in the fluidized bed within the fluidized-bed combustion chamber 3 under addition of an oxidizing agent, which is usually air and which at the same time serves as a fluidizing medium, as well as possibly other agents (additives, secondary or tertiary air, recirculated flue gas, etc.). The combustion gas or flue gas 19 arising in the combustion process, which contains solid particles, is directed upward in the fluidized-bed combustion chamber 3 by the fluidizing medium that has been introduced from below into the fluidized-bed combustion chamber 3, and subsequently it is directed into a separator 4, in which the solid particles (fluidized-bed inert material, ash, unburned matter) are separated as much as possible from the flue-gas stream 19 and can be fed via a line 20 again into the fluidized-bed combustion chamber 3. The flue gas stream 19 that has been cleaned as much as possible is fed from the separator 4 via a line 21 to the second gas pass 5 of the steam generator 1, in which at least one superheater heating surface 8, an initial reheater 9, and at least one economizer heating surface 6 are positioned, and in which a large portion of the heat contained in the flue-gas stream 19 is delivered to the water/steam working medium flowing in the above-mentioned heating surfaces 6, 8, 9.

The second gas pass 5 is usually constructed in an essentially vertical orientation, and the flue-gas stream 19 usually flows through it from top to bottom. The sequence of the heating surfaces 6, 8, 9 positioned in the second pass 5 and shown in FIGS. 1 to 3 can also be different from the sequence shown there, depending on the usage requirements. And depending on the requirements placed on the structural shape of the steam generator unit 1, the second gas pass 5 can also be constructed to have a horizontal or partly a horizontal and partly a vertical orientation.

The superheater heating surface, first reheater heating surface, and economizer heating surface 6, 8, 9 are usually constructed as convective heating surfaces, especially as bundled heating surfaces, namely the heating tubes of the respective heating surfaces are bundled into heating-surface packets.

After passage through the second gas pass 5, the flue-gas stream 19 can be introduced to a further treatment process before it is discharged into the atmosphere.

The steam generator unit 1 in accordance with the invention is constructed to have two reheaters 9, 10, with the first reheater or stage 9 being positioned in the second gas pass 5 and the second reheater or stage 10, which is also referred to as the final reheater, being positioned in the fluidized-bed combustion chamber 3. It is preferable for this to have a regulating mechanism 14 that divides up the steam that comes from the high-pressure stage of the steam turbine 2, and that is partially expanded, into a partial flow directed through the first reheater 9 and possibly a partial flow directed through the bypass line 16. Since the two reheater stages 9, 10 are connected in series on the steam side and the bypass line 16 directs a steam partial flow only past the first reheater 9, the steam partial flows are brought together again, downstream of the first reheater 9 as seen in the flow direction of the steam, and are fed jointly to the second reheater 10.

The dividing up into the above-mentioned steam partial flows by the regulation mechanism 14, which includes at least several temperature-measuring points 22 and at least one flow-rate regulating valve 13, takes place as a function of the steam temperatures at the inlet and outlet of the first reheater 9 and the steam temperatures at the inlet and outlet of the second reheater 10. From the measured values or actual values of the aforementioned steam temperatures involved in the regulation mechanism 14 a controlled variable or value is constructed and directed to a flow-rate regulating valve 13, which depending on this controlled variable divides up the steam partial flows. Moreover in accordance with FIGS. 1 to 3 a 3-way valve can be used as the flow-rate regulating valve 13, which divides up and regulates the steam partial flows at the bifurcation of the supply line 15 to the first reheater 9 and the bypass line 16.

Figure 4:
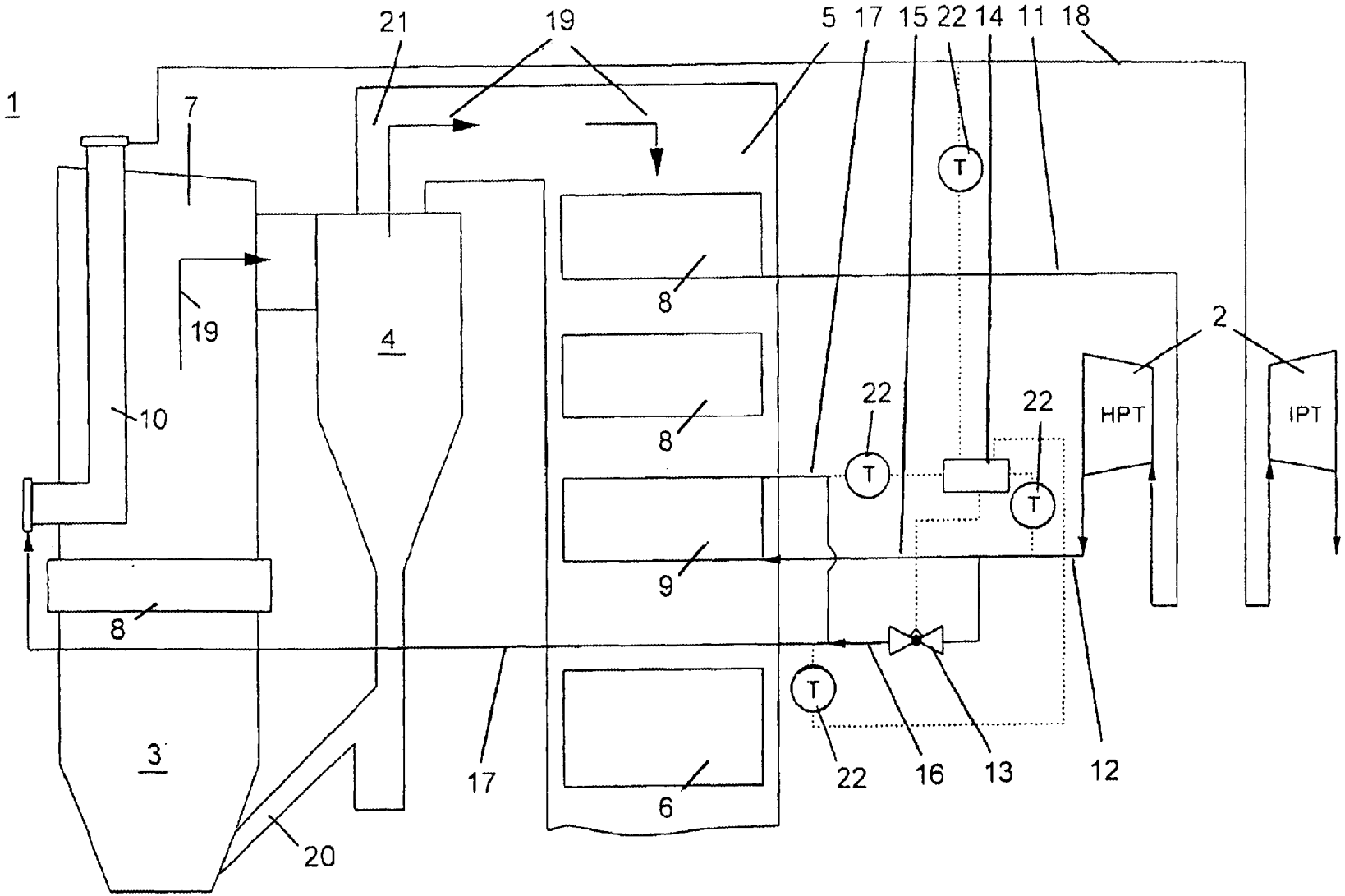
FIG. 4 is a schematic diagram of a fourth embodiment of a steam generator unit in accordance with the invention.

The steam partial flows can also be divided up and regulated by a flow-rate regulating valve 13 that is positioned in the bypass line 16 in accordance with FIG. 4.

The regulation of the reheater temperatures in steam generator units 1 is necessary since the flue-gas temperatures prove to be different with different boiler loads. In practice this means that when the boiler loads are less than 100% (100% corresponds to full load) the RG temperatures are lower, and the ZÜ temperatures would likewise turn out to be lower without some intervention. But in order to achieve the requisite ZÜ temperatures, in the steam generator unit 1 in accordance with the invention at full load a regulated steam partial flow is directed through the bypass line 16, whereas when there is a partial load the amount of the steam partial flow directed and regulated through the bypass line 16 turns out to be smaller compared to the full load and can even drop to zero. With this measure, regardless of the boiler load a constant reheater temperature can be maintained and the intermediate-pressure section of the steam turbine 2 can be acted upon by steam in accordance with the requirements.

The steam generator unit 1 in accordance with the invention is characterized by an improved temperature characteristic for the reheater stages 9, 10, which in turn entails a smaller heating-surface requirement compared to the familiar state of the art and thus lower construction costs.

It is advantageous for the second reheater stage 10 to be formed out of platen-type heating surfaces. These consist of tube walls that can have a separation from one another of 800 to 1000 mm, for example, and that are positioned at right angles to the flow direction of the RG stream 19, with the respective tubes of a platen-type heating surface lying parallel to the RG stream 19. The positioning or construction of the second reheater 10 in the form of platen-type heating surfaces permits heat absorption by convection as well as by radiation from the combustion chamber 3.

Figure 2:
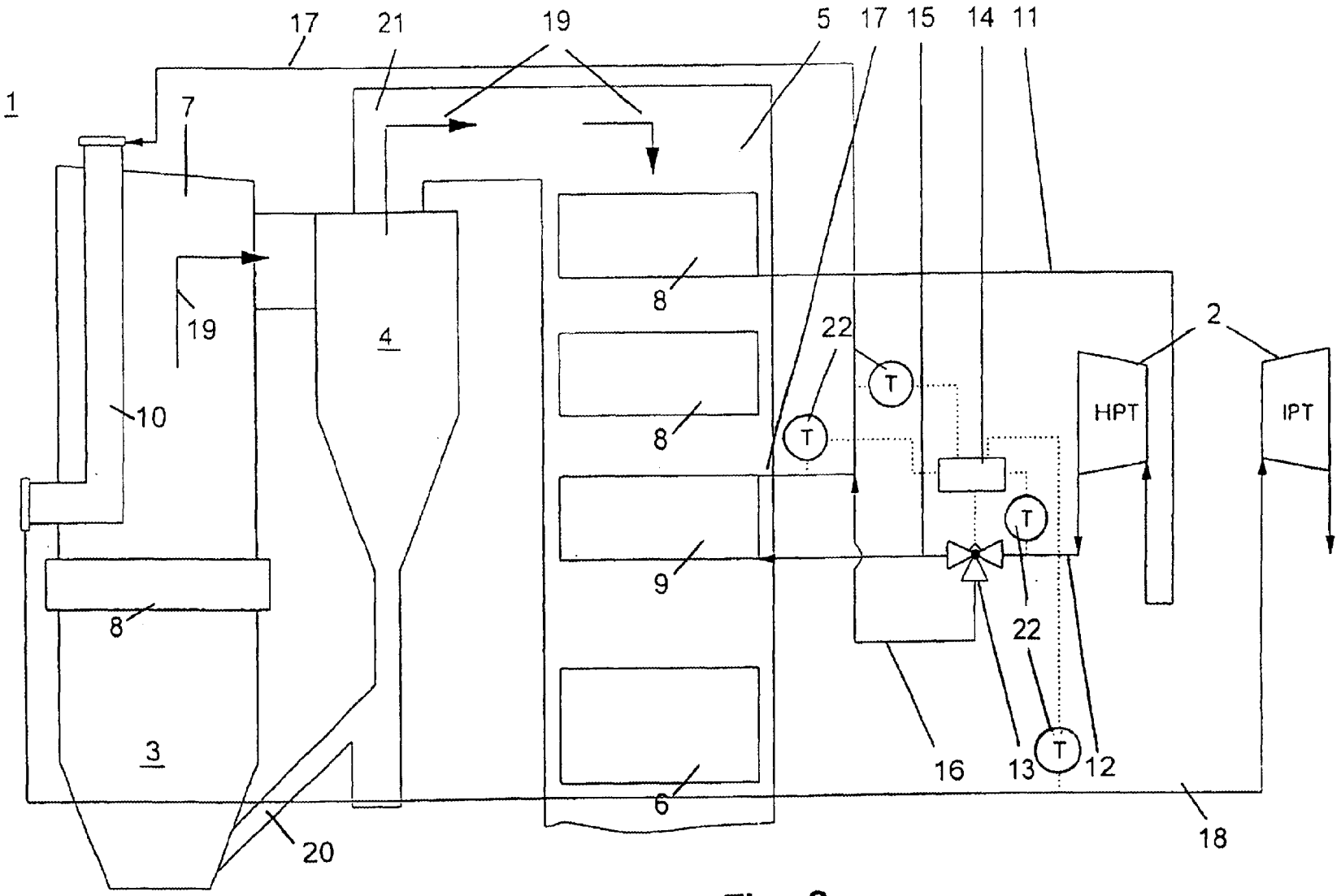
FIG. 2 is a schematic diagram of a second embodiment of a steam generator unit in accordance with the invention.

In another advantageous embodiment of the invention, the platen-type heating surfaces of the second reheater (10) are constructed in the shape of an L (FIGS. 1, 2, and 4). Through this embodiment the installation of these platen-type heating surfaces and the linking of the heating-surface tubes can be done very simply. With the L-shaped platen heating surfaces, one portion of the heating surface is always constructed at right angles to and another portion of the heating surface is always along the flow direction of the RG stream 19. In accordance with FIG. 3, the platen-type heating surface of the second reheater (10) can also be run horizontally through the fluidized-bed combustion chamber (3).

Figure 3:
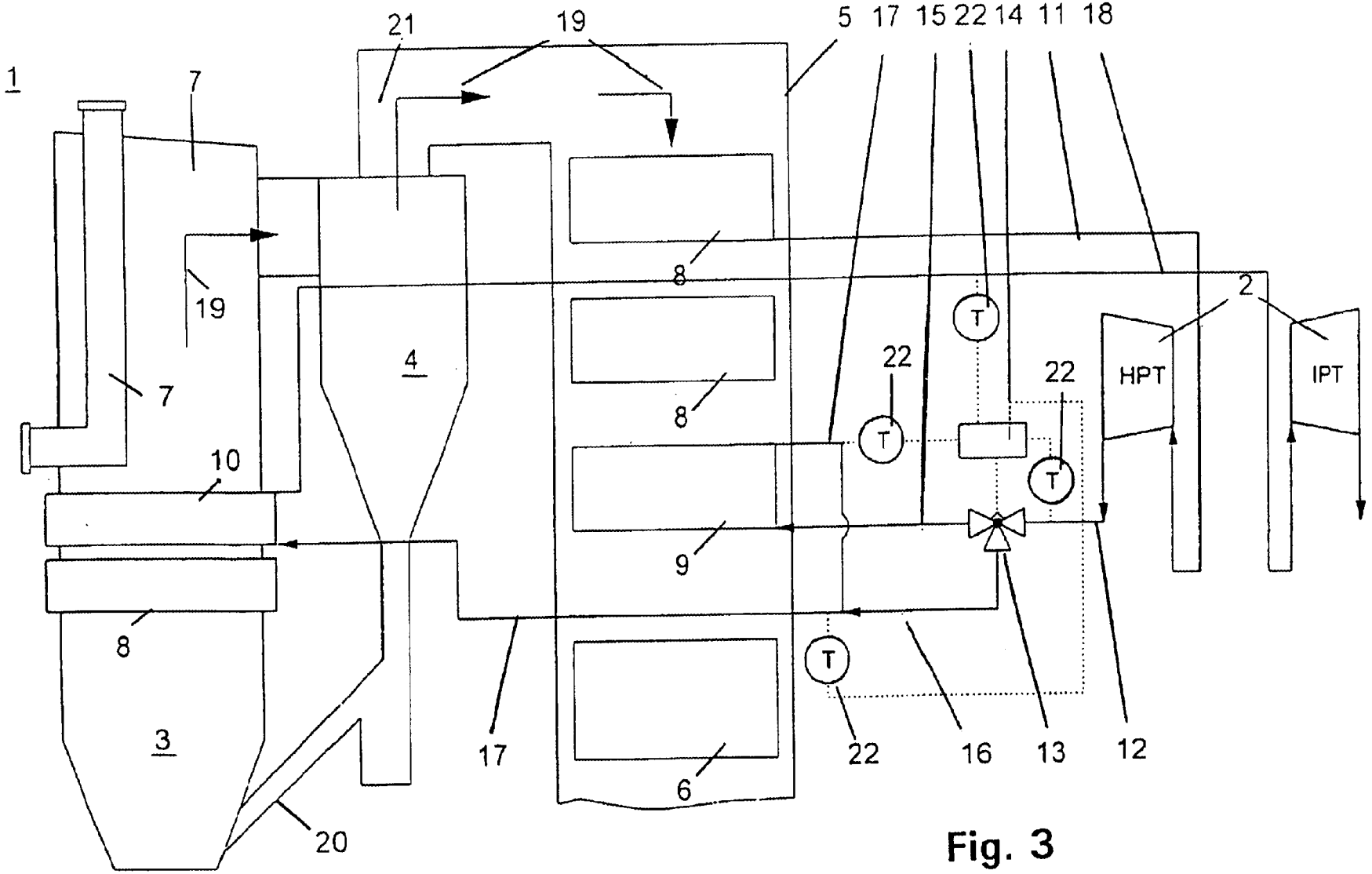
FIG. 3 is a schematic diagram of a third embodiment of a steam generator unit in accordance with the invention.

In contrast to the construction of the steam generator unit 1 in FIGS. 1 and 3 in accordance with the invention, in which it is advantageous for the working medium to be directed in a parallel flow through the second reheater 10, seen in relation to the flow direction of the RG stream 19 in the fluidized-bed combustion chamber 3, the working medium can also be conveyed, relative to the direction of flow of the RG current 19, in a counterflow through the second reheater 10 (FIG. 2). This can be of advantage in certain applications.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Steam generator unit with a fluidized-bed combustion system, which has a fluidized-bed combustion chamber, at least one second gas pass, and at least one separator positioned between the fluidized-bed combustion chamber and second gas pass, at least one superheater and two reheaters connected in series on the steam side, wherein the first reheater is constructed with a regulated bypass mechanism on the steam side, so that a partial flow of the steam that is fed to the second reheater can be directed past the first reheater, wherein the improvement comprises that the first reheater is positioned within the second gas pass and the second reheater is positioned within the fluidized-bed combustion chamber.

2. Steam generator unit according to claim 1 wherein the second reheater is constructed as a platen-type heating surface.

3. Steam generator unit according to claim 2 wherein the platen-type heating surface of the second reheater is constructed in the shape of an L.

4. Steam generator unit according to claim 2 wherein the platen-type heating surface of the second reheater is run horizontally through the fluidized bed combustion chamber.

5. Steam generator unit according to claim 1 further comprising a regulation mechanism including at least one flow-rate regulating valve for dividing up the steam flow into a partial flow directed through the first reheater and selectively a partial flow directed through the bypass line, wherein the regulation is done as a function of the steam temperatures at the inlet and outlet of the first reheater as well as the steam temperatures at the inlet and outlet of the second reheater.

6. Steam generator unit according to claim 5 wherein the flow-rate regulating valve is constructed as a 3-way valve and is positioned at the bifurcation to the supply line to the first reheater and to the bypass line.

7. Steam generator unit according to claim 5 wherein the flow-rate regulating valve is constructed as a straight-through valve and is positioned in the bypass line.

8. A procedure for the regulation of reheater temperatures in a steam generator having a fluidized-bed combustion system which includes a fluidized-bed combustion chamber, at least one second gas pass, and at least one separator positioned between the fluidized-bed combustion chamber and second gas pass, and at least one superheater and two reheaters connected in series on the steam side, the first reheater being constructed with a regulated bypass mechanism on the steam side, whereby a partial flow of the steam fed to the second reheater can be directed past the first reheater, the procedure comprising heating the steam flow in the first reheater within the second gas pass and heating the steam flow in the second reheater within the fluidized-bed combustion chamber.

9. Procedure according to claim 8, further comprising regulating the steam flow through the first reheater and the steam flow selectively directed through the bypass line as a function of the steam temperatures at the inlet and outlet of the first reheater and at the inlet and outlet of the second reheater, respectively.

10. Procedure according to claim 8 wherein the steam is directed in a parallel flow through the second reheater relatively to the direction of flow of the flue-gas stream in the fluidized-bed combustion chamber.

11. Procedure according to claim 8 wherein the steam is directed in a counterflow through the second reheater relatively to the direction of flow of the flue-gas stream in the fluidized-bed combustion chamber.

* * * * *